United States Patent [19]

Apothéloz et al.

[11] Patent Number: 4,726,294

[45] Date of Patent: Feb. 23, 1988

[54] PROJECTILE IMPACT FUZE CONTAINING DE-ARMING DEVICE

[75] Inventors: Robert Apothéloz, Greifensee; Georg Leutwyler, Regensdorf, both of Switzerland

[73] Assignee: Werkzeugmaschinenfabrik Oerlikon-Bührle AG, Zürich, Switzerland

[21] Appl. No.: 939,870

[22] Filed: Dec. 9, 1986

[30] Foreign Application Priority Data

Dec. 17, 1985 [CH] Switzerland ..... 05379/85

[51] Int. Cl.[4] ..... F42C 15/04; F42C 15/34

[52] U.S. Cl. ..... 102/255; 102/221; 102/246; 102/247; 102/256

[58] Field of Search ..... 102/247, 254–257, 102/264, 272, 273, 274, 235, 238, 222

[56] References Cited

U.S. PATENT DOCUMENTS

| | | | |
|---|---|---|---|
| 3,107,618 | 10/1963 | Vanover | 102/251 X |
| 4,007,689 | 2/1977 | Apothéloz | 102/255 X |
| 4,154,169 | 5/1979 | Petiteau | 102/238 X |
| 4,449,457 | 5/1984 | Halssig | 102/255 X |

FOREIGN PATENT DOCUMENTS

| | | |
|---|---|---|
| 0075496 | 3/1983 | European Pat. Off. . |
| 3108659 | 9/1982 | Fed. Rep. of Germany . |
| 2563622 | 10/1985 | France . |
| 2072809 | 10/1981 | United Kingdom . |

*Primary Examiner*—David H. Brown
*Attorney, Agent, or Firm*—Werner W. Kleeman

[57] ABSTRACT

It happens time and again that a fuze does not function and that the projectile remains in the field or the place where it landed as a dud. When such a dud is found the danger exists that it might explode upon the finder's touch or when moved or lifted. To prevent this danger the impact fuze in a dud should be able to de-arm itself in a non-explosive manner. This is achieved by positioning a dud insert or de-arming device between an explosive or firing train and a booster charge. This dud de-arming device contains an escapement device which after a predetermined delay time following impact of the projectile moves a rotor from its armed or live position into its de-armed or inert position. The dud de-arming device contains structure which, by virtue of the impact delay or deceleration, that is a delay in ignition of the booster charge upon the projectile hitting the target or ground, activates the escapement mechanism.

5 Claims, 4 Drawing Figures

PROJECTILE IMPACT FUZE CONTAINING DE-ARMING DEVICE

BACKGROUND OF THE INVENTION

The present invention broadly relates to an impact fuze for a warhead, typically a projectile and, more specifically, pertains to a new and improved construction of a projectile impact fuze containing means or a de-arming device for de-arming the warhead or projectile fuze.

Generally speaking, the projectile impact fuze of the present invention comprises a fuze casing with a lengthwise bore for accommodation of an explosive firing train or explosive lead therein. A slide member is located in the fuze casing and is displaceable in a direction transverse to the abovementioned lengthwise direction from its de-armed or safety position into its armed or live position. The impact fuze also comprises a firing pin serving to pierce and thereby ignite a firing pellet when the slide member is in its armed position or state. The impact fuze further contains a booster charge. This booster charge serves for the detonation of the projectile and can be initiated or ignited after the ignition of the explosive lead or explosive firing train located in the aforementioned lengthwise bore upon ignition of the firing pellet.

Such impact fuzes are known in different constructions U.S. Pat. No. 2,999,461 and European Patent Publication No. 0,155,449 serve to teach examplary embodiments thereof.

As is well known, it happens time and again that such an impact fuze does not function and that the projectile remains in the field as a so-called dud. Also recurring are cases whereby such duds explode or detonate in the hand of a person finding them.

SUMMARY OF THE INVENTION

Therefore with the foregoing in mind it is a primary object of the present invention to provide a new and improved construction of a projectile impact fuze which does not exhibit the aforementioned drawbacks and dangers of the prior art constructions.

Another and more specific object of the present invention aims at providing a new and improved construction of a projectile impact fuze of the previously mentioned type which is able to de-arm or sterilize itself in the event that the projectile does not explode or detonate immediately upon impact at the target.

Yet a further significant object of the present invention aims at providing a new and improved construction of a projectile impact fuze of the character described and containing a dud de-arming device and which is relatively simple in construction and design, extremely economically to manufacture, highly reliable in operation, not readily subject to breakdown and malfunction and affords enhanced protection against unintentional detonation of the projectile when it becomes a so-called dud.

Now in order to implement these and still further objects of the present invention which will become more readily apparent as the description proceeds the projectile impact fuze of the present invention is manifested by the features that a dud insert or dud de-arming device is located between the explosive lead or explosive firing train and the booster charge. This dud insert or de-arming device comprises a rotor which is displaceable or movable from its armed position into its de-armed position. The dud insert or de-arming device further comprises an escapement or sterilizer device which is able to displace the rotor from its armed position into its de-armed position after the elapse of a predetermined time period or delay time. The dud insert or de-arming device further is provided with means which activate or initiate the escapement device as a result of impact of the projectile and delay in detonation thereof.

Preferably the means for activating the escapement device comprises a detent member or detent pin or bolt. The detent pin or bolt can assume a first position where it locks or retains the escapement device in its armed position. In a second position of the detent pin or bolt the escapement device is released or activated. The detent pin or bolt is displaced from its retaining or locking position into its release position by virtue of its inertia or deceleration forces induced by the impact of the projectile.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
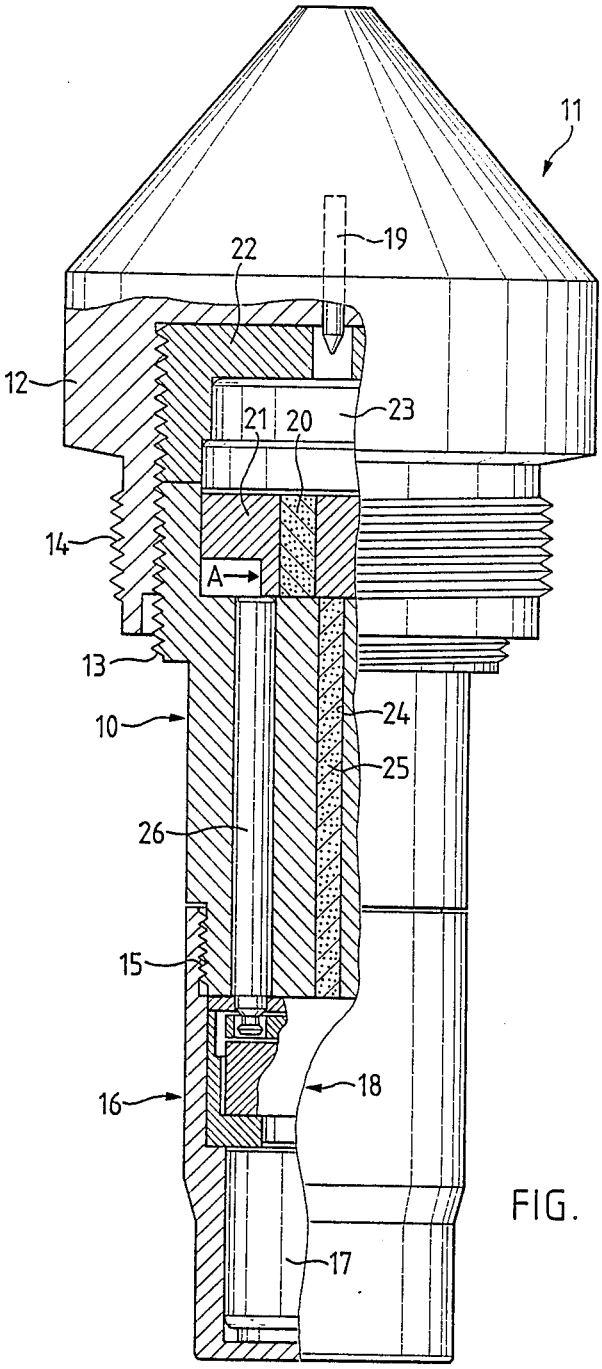
FIG. 1 shows a fragmentary sectional view in side elevation of a projectile impact fuze containing the dud insert or de-arming device in accordance with the present invention.

Describing now the drawings, it is to understood that to simplify the showing thereof only enough of the structure of the projectile impact fuze has been illustrated therein as is needed to enable one skilled in the art to readily understand the underlying principles and concepts of the present invention. Turning now specifically to FIG. 1 of the drawings, the projectile impact fuze 11 illustrated therein by way of example and not limitation will be seen to comprise a fuze casing or housing 10 screwed to a fuze head or nose 12 by means of a thread or screw connection 13. The fuze head or nose 12 is screwed onto a not illustrated body of the projectile by means of a second thread or screw connection 14. A sleeve or tubed cap 16 equipped with a booster charge 17 and with a dud insert or de-arming device 18 is screwed to the lower portion of the fuze casing or casing 10 by means of a further thread or screw connection 15. A firing pin 19, only the tip of which has been conveniently shown, is mounted in the fuze head or nose 12 for translatory movement. This firing pin 19 serves to pierce or puncture a firing pellet 20 provided in a slide member 21. As is well known in this art, this slide member 21 is movable or displaceable from the shown inert or de-armed or safety position in the direction of arrow A into its active or armed or live position such that the firing pellet 20 comes to be in the proximity of the firing pin 19.

Inserted into the fuze head or nose 12 is a housing 22 which houses or contains the salient or essential elements of the impact fuze 11, especially an escapement or retarding mechanism 23. Because of this escapement mechanism 23 there is ensured the barrel security of the fuze such that the projectile can not prematurely detonate right after leaving the firing barrel of the weapon. This escapement mechanism 23 renders certain that the slide member 21 can only be first moved into its armed position, after the launching of the projectile, the latter has moved out of the proximity of the firing weapon or the like from which it is fired. The casing 10 possesses a central bore 24 to accommodate or house an explosive firing train or explosive lead 25. This explosive lead or lead charge 25 is detonated or ignited by the firing pellet 20 and, in turn, by means of the dud insert or de-arming device 18 initiates or ignites or detonates the booster charge 17. Adjacent the explosive lead or lead charge 25 a detent pin or bolt or detent member 26 is axially displaceably mounted in the casing 10. This detent pin or bolt 26 abuts with its upper end against the slide member 21 as long as the latter is in its de-armed or dis-armed position. The lower end of the detent pin 26 projects or protrudes into the dud insert or de-arming device 18. As will be described more fully hereinafter the operative connection between the explosive lead or lead charge 25 and the booster charge 17 will be interrupted in a predetermined time period after the detent pin or bolt 26 has slid out of the dud insert or de-arming device 18.

Figure 2:
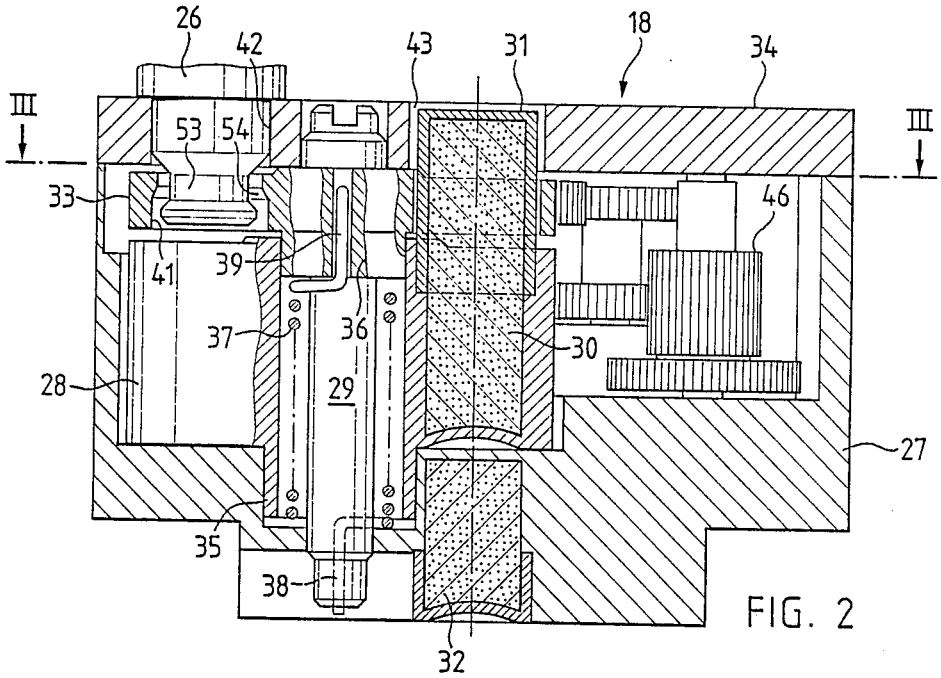
FIG. 2 shows a sectional view in side elevation of the inventive dud insert or de-arming device in its armed position on an enlarged scale.
Figure 3:
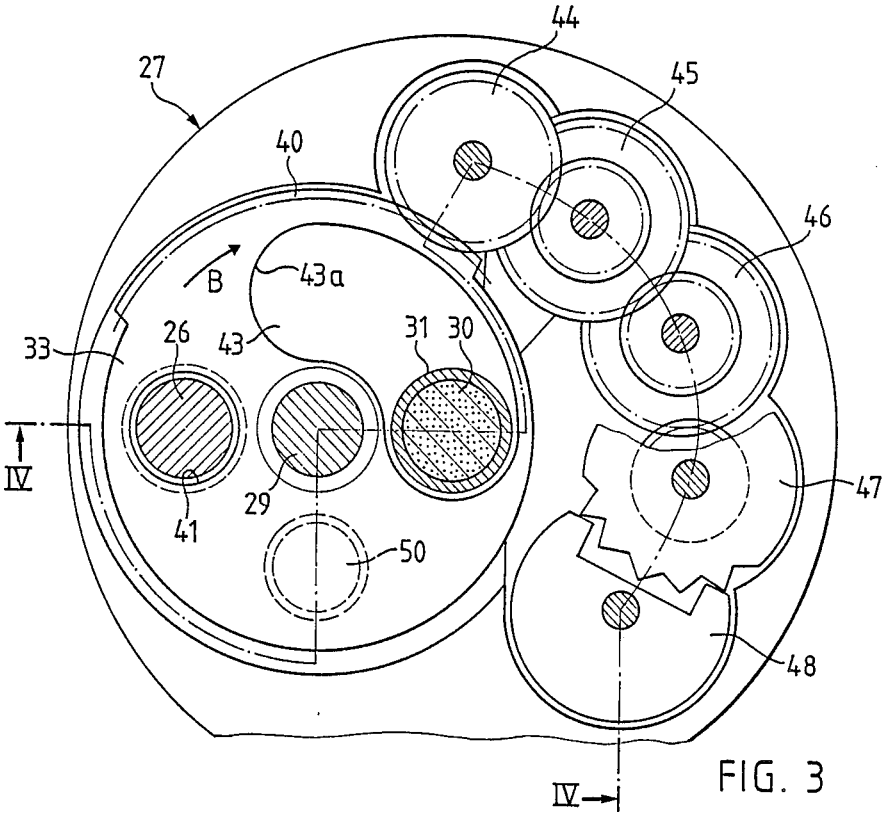
FIG. 3 shows a horizontal sectional view taken substantially along the line III—III in FIG. 2.

This dud insert or de-arming device 18 will now be described in detail with reference to FIGS. 2, 3 and 4. As can be seen from FIGS. 2 and 3 the dud insert or de-arming device 18 comprises a housing 27 with a rotor 28 disposed therein. The rotor 28 is rotatable about a pivot shaft or axis 29 and houses an explosive firing train or explosive lead or lead charge 30. The explosive lead or lead charge 30 extends substantially parallel to the pivot shaft or axis 29. The upper portion of this explosive lead or lead charge 30 is enclosed by a sleeve or tubed jacket 31 and protrudes outwardly from the rotor 28. A further explosive lead or lead charge 32 is provided in the housing 27 and the axis of which coincides with that of the housing 27. In the position as depicted by FIGS. 2 and 3 the lengthwise axes of both of the explosive leads or lead charges 30 and 32 also coincide. In this position the explosive lead or lead charge 25 illustrated in FIG. 1 is in alignment with both the explosive leads or lead charges 30 and 32 and is able to ignite or detonate the booster charge 17 by means of these explosive leads or lead charges 30 and 32.

A disk or plate 33 is disposed above the rotor 28 and has the same diameter as the rotor 28. This disk or disk member 33 is provided with a toothed segment or sector gear portion 40. Furthermore, the disk 33 is rigidly attached to the pivot shaft or axis 29. A lower end of the pivot shaft or axis 29 is rotatably mounted in the housing 27 and an upper end of the pivot shaft or axis 29 is rotatably mounted in a cover or cover member 34 provided for the housing 27. The bottom portion of the rotor 28 is provided with a projecting sleeve or sleeve-like projection 35 which is rotatably mounted in the housing 27 whereas the top portion of the rotor 28 is rotatably journaled around a collar or journal 36 affixed to the disk 33. A helical torsion or torsional spring 37 having a lower end 38 and an upper end 39 is provided around the pivot shaft or axis 29. The lower end 38 of the torsion spring 37 is anchored in the housing 27 whereas its upper end 39 is inserted into or anchored at the disk 33. This torsion spring 37 is pre-biased or pre-tensioned such that it biases the disk 33 in a clockwise direction according to the direction of the arrow B in FIG. 3.

In the armed position of the dud insert or de-arming device 18 as shown in FIG. 2, a bore 41 of the disk 33 is in alignment with a bore 42 of the cover 34. The detent bolt or pin or lock pin 26 will be seen to extend through both of the bores 41 and 42. As long as the detent bolt or pin 26 remains in its locking or retaining position as shown in FIG. 2, i.e. in a position where it projects into both the bores 41 and 42 of the disk 33 and the cover 34, respectively, the pretensioned torsion spring 37 is prevented from rotating the disk 33 in the direction of the arrow B. Apart from the bore 41 the disk 33 also possesses an arcuately extending aperture or oblong hole 43, shown in FIG. 3, into which projects the explosive lead or lead charge 30 which is enclosed by the sleeve or tubed jacket 31. The disk 33 with its toothed segment 40 thereof is operatively connected with a balance wheel or oscillating armature 48 through a gearing or gear train comprising four gear wheels or gears 44, 45, 46 and 47 as can be seen in FIGS. 3 and 4. The four gear wheels or gears 44, 45, 46 and 47 as well as the balance wheel 48 are rotatably mounted around related journal pins or shafts 49. The parts 29, 33, 44, 45, 46, 47 and 48 can be considered to comprise components of the escapement device of the inventive dud insert or de-arming device 18.

Figure 4:
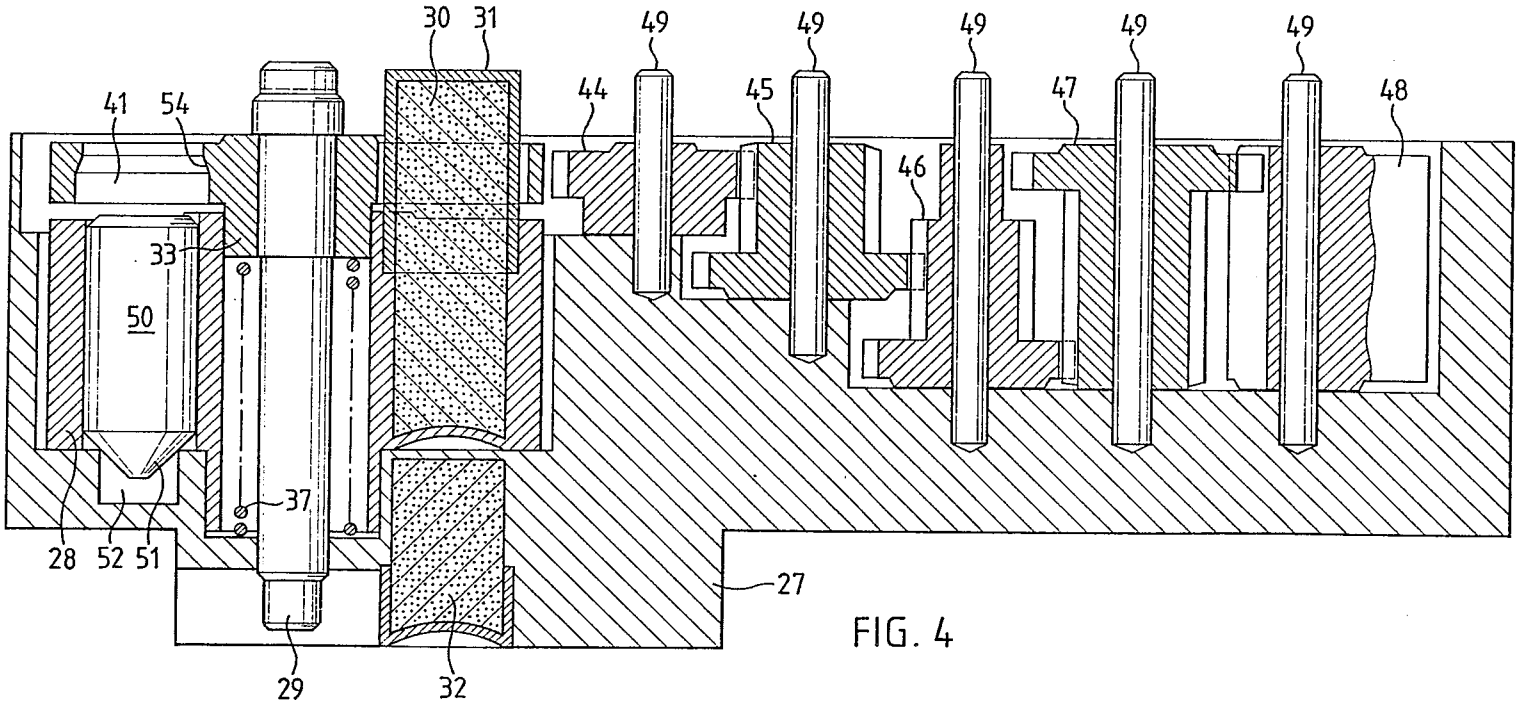
FIG. 4 shows a cross sectional view taken substantially along the line IV—IV in FIG. 3.

In addition, as shown in FIGS. 3 and 4, a security bolt or pin 50 is disposed in the rotor 28 and its cone or conical tip 51 at the lower end thereof projects into a bore 52 of the casing 27. The other upper end of this security or safety bolt or pin 50 is normally in abutting engagement with the disk 33 i.e. the bottom face or surface thereof, but according to the showing of FIG. 4 can be moved upwardly into the arcuately extending aperture or oblong hole 43 so that the cone or conical tip 51 of the security or safety bolt or pin 50 can move out of the bore 52 of the housing 27 in order to release the rotor 28 for performing its rotation. It will be appreciated that as long as the cone or conical tip 51 of the security or safety bolt or pin 50 remains in the bore 52 of the housing 27 the rotor 28 is unable to rotate.

As is clearly shown in FIG. 2 the detent bolt or pin or detent member 26, which can also be referred to as a sensor pin, possesses at the lower end portion thereof a groove 53. Also, the bore 41 of the disk 33 contains a peripheral truncated cone-shaped or conical surface 54. Attention is drawn to FIG. 3 where the helical pre-biased torsion spring 37, as explained before, urges the disk 33 to rotate in the direction of the arrow B. By doing so the cone-shaped or conical surface 54 is pressed against the groove 53 of the detent bolt or pin 26 thereby preventing or at least hampering an unintentional slippage of the detent bolt or pin or sensor pin 26 out of the bore 41 of the disk 33.

From the foregoing description the operation of the projectile impact fuze and especially of the of dud insert or de-arming device 18 should be readily apparent and will be described hereinafter.

Before firing of the projectile the detent bolt or pin 26 retains or locks the rotor 28 of the dud insert or de-arming device 18 in its armed position thereof as depicted in FIGS. 2 and 3. It will be appreciated that at this time the explosive leads or lead charges 25, 30, 32 and booster charge 17 are all in alignment and the entire explosive train is complete apart from the firing pellet 20 and slide member 21. The pre-biased or pretensioned helical torsion spring 37 strives to rotate the disk 33 in a clockwise direction according to the arrow B. As a result of this spring-loading of the disk 33 the cone-shaped or conical surface 54 of the bore 41 of the disk 33 comes into engagement with or bears against the groove 53 of the detent bolt or pin 26 and hinders or impedes an inadvertent release thereof from the dud insert or de-arming device 18. Apart from this and as shown in FIG. 1 the slide member 21 is in its de-armed or safety position thereby preventing a translatory displacement of the detent bolt or pin 26 since the upper or front portion thereof abuts against the lower surface or face of the slide member 21.

After firing of the projectile, i.e. as soon as the projectile has moved away from the proximity of the firing weapon or launching device from which the projectile was fired, the slide member 21 together with the firing pellet 20 is displaced or moved into its armed position. The particular nature of this displacement of the slide member 21 is well known in the art and will therefore be fully understood by those skilled in the art without any additional description thereof. Upon completion of this appropriate displacement of the slide member 21 the explosive train is complete, i.e. all its components are aligned with one another. Further, the detent bolt or pin 26 is free to move forward in the direction of travel of the projectile as far as the slide member 21 is concerned, since the prior abutting engagement with the slide member 21 is no longer present. The deceleration or retardation of the projectile due to the air resistance does not suffice to axially forwardly displace the detent bolt or pin 26. But as soon as the projectile impacts against the target or for that matter the ground, should the projectile miss its target, the deceleration or retardation of the projectile will become so great that, due to inertia, the detent bolt or pin 26 is thrown or thrusted forwardly against the resistance caused by the cone-shaped or conical surface 54 engaging with the groove 53 of the detent bolt or pin 26 thereby completely disengaging from the dud insert or de-arming device 18. Now the torsion spring 37 is able to clockwise rotate the disk 33 in the direction of the arrow B. This rotation of the disk 33 is slowed down or retarded by the balance wheel or oscillating armature 48 and the gear wheels or gears 44, 45, 46 and 47. After a rotation of the disk 33 through approximately 90° the toothed segment 40 will come out of meshing engagement with the gear wheel 44. Thereafter the disk 33 can rotate through a further angle of approximately 90° and this rotation is accomplished at a considerably greater speed. An edge 43*a* of the arcuately extending aperture or oblong hole 43 of the disk 33 impinges, however, against the sleeve or tubed jacket 31 of the explosive lead or lead charge 30 after a rotation of the disk 33 through an angle of 90°, thus also causing the rotor 28 to rotate through an angle of 90°. The rotor 28 is thus rotated from its armed position into its de-armed or inert position. The explosive or lead charge 30 in the rotor 28 is thus moved out of alignment with the explosive or lead charge 25 in the casing 10 and with the booster charge 17 thereby breaking the circuit of the explosive train by removing a component of this explosive train. The booster charge 17 therefore can not be ignited or detonated provided that this booster charge 17 has not been detonated beforehand.

Upon impact of the projectile at the target or at the ground, as the case may be, the firing pin 19 is immediately pushed against the firing pellet 20 setting into operation the explosive train comprising the explosive leads or lead charges 25, 30 and 32 and ultimately igniting or detonating the booster charge 17. The time duration to ignite the booster charge 17 is much shorter than the time period necessary to rotate the dud insert or de-arming device 18 in the aforedescribed manner from its projectile arming position into its de-arming or safety position.

In case an ignition or detonation of the booster charge 17 has not taken place before the rotor 28 of the dud insert or de-arming device 18 has reached its de-armed position it is positively ensured that a subsequent ignition and detonation of the projectile is prevented.

While there are shown and described present preferred embodiments of the invention, it is to be distinctly understood that the invention is not limited thereto, but may be otherwise variously embodied and practiced within the scope of the following claims.

Accordingly, what we claim is:

1. A projectile impact fuze, comprising:

a casing having a bore extending in a lengthwise direction thereof;

a lead charge accommodated within said bore;

a slide member located in said casing and displaceable in a transverse direction with respect to said lengthwise direction of said casing from a de-armed into an armed position;

a firing pellet positioned at said slide member for igniting said lead charge;

a firing pin for piercing and igniting said firing pellet when said slide member is in said armed position thereof;

a booster charge for augmenting detonation of the projectile;

said booster charge being ignitable after ignition of said lead charge;

a dud de-arming device located between said lead charge and said booster charge and comprising:

a rotor displaceable from an armed position into a de-armed position thereof;

an escapement device for allowing displacement of said rotor from said armed position into said de-armed position thereof after the elapse of a predetermined time period; and means for activating said escapement device in response to impact of the projectile.

2. The projectile impact fuze as defined in claim 1, wherein:

said activating means for said escapement device comprising a detent member;

said detent member possessing a locking position for retention of said escapement device in an armed position thereof;

said detent member further possessing a release position for freeing said escapement device from said retension thereof by said detent member; and said detent member being moved from said locking position into said release position thereof by deceleration forces induced by impact of the projectile.

3. The projectile impact fuze as defined in claim 2, wherein:

said detent member having a first end portion;

said first end portion being in abutting relationship with said slide member when said slide member is in said de-armed position thereof in order to avoid premature translatory displacement of said detent member into said release position thereof;

said detent member having a second end portion;

said escapement device possessing a disc;

said disc possessing a bore; and said second end portion projecting into said bore of said disc of said dud de-arming device in order to retain said rotor in said armed position thereof.

4. The projectile impact fuze as defined in claim 3, wherein:

said second end portion of said detent member possessing a groove;

said bore having a peripheral substantially cone-shaped surface; and said groove of said second end portion of said detent member being in abutting engagement with said peripheral substantially cone-shaped surface of said bore in order to retain said detent member in said locking position thereof.

5. A projectile impact fuze for a projectile containing an explosive lead and a booster charge and which projectile becomes a dud after failing to fire upon impact and contains a dud de-arming means, said dud de-arming means comprising:

a dud de-arming device located between the explosive lead and the booster charge;

said dud de-arming device comprising:

a rotor displaceable from an armed position into a de-armed position;

an escapement device for allowing displacement of said rotor from said armed position into said de-armed position thereof after the elapse of a predetermined time period following impact of the projectile; and means for activating said escapement device in response to impact of the projectile.

* * * * *